US010519843B2

(12) United States Patent
Litzel

(10) Patent No.: US 10,519,843 B2
(45) Date of Patent: Dec. 31, 2019

(54) VALVE BODY OF A GAS EXCHANGE VALVE, GAS EXCHANGE VALVE AND INTERNAL COMBUSTION ENGINE

(71) Applicant: MAN DIESEL & TURBO SE, Augsburg (DE)

(72) Inventor: Georg Litzel, Dinkelscherben (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 15/707,426

(22) Filed: Sep. 18, 2017

(65) Prior Publication Data

US 2018/0080365 A1 Mar. 22, 2018

(30) Foreign Application Priority Data

Sep. 20, 2016 (DE) ..... 10 2016 117 698

(51) Int. Cl.
*F01N 13/06* (2010.01)

(52) U.S. Cl.
CPC ..... *F01N 13/06* (2013.01)

(58) Field of Classification Search
CPC .... F02M 59/46; F01L 3/02; F01L 3/00; F01L 3/22; F01L 3/20; F01L 2101/00; F01L 2101/02; F01L 3/06; F01L 3/14; F01L 3/16; F01L 3/18; F16K 15/023
See application file for complete search history.

(56) References Cited

U.S. PATENT DOCUMENTS 2,087,858 A * 7/1937 Hirsch ..... B61F 17/02 384/162
2,183,254 A * 12/1939 Charlton ..... B23P 15/002 29/888.453
2,407,561 A * 9/1946 Lincoln ..... F01L 3/14 123/188.3
2,432,761 A * 12/1947 Hoern ..... B23K 11/002 219/93
2,435,948 A * 2/1948 Wischhusen ..... F16K 27/00 29/888.452
3,871,339 A * 3/1975 Kuhn ..... F01L 3/18 123/41.41

(Continued)

FOREIGN PATENT DOCUMENTS

FR 899950 6/1945
FR 2051731 4/1971

OTHER PUBLICATIONS

Written Opinion and Search Report dated Oct. 11, 2019 issued in French Patent Application No. 1757410.

*Primary Examiner* — Long T Tran
(74) *Attorney, Agent, or Firm* — Cozen O'Connor

(57) ABSTRACT

A valve body for a gas exchange valve of a cylinder of an internal combustion engine can be brought to lie against a valve seat of the gas exchange valve for closing the gas exchange valve and can be removed from the valve seat to open the gas exchange valve. The valve body is formed in multiple parts and has a first valve disc part interacting with the valve seat and a second valve disc part that is connected to the first valve disc part in a fixed manner and faces a combustion chamber of the cylinder. Between the first valve disc part and the second valve disc part a hollow space serving at least for the cooling of the second valve disc part is formed.

9 Claims, 2 Drawing Sheets

(56) References Cited

U.S. PATENT DOCUMENTS

| | | | | |
|---|---|---|---|---|
| 6,244,234 | B1 * | 6/2001 | Hoeg | C22F 1/10<br>123/188.3 |
| 6,298,817 | B1 * | 10/2001 | Hoeg | C22C 19/05<br>123/188.3 |
| 8,757,124 | B2 * | 6/2014 | Hoeg | B22F 3/15<br>123/188.3 |
| 2007/0240668 | A1 * | 10/2007 | Burton | F01L 3/04<br>123/188.3 |
| 2015/0240675 | A1 * | 8/2015 | Homma | F01L 3/16<br>251/366 |
| 2016/0326919 | A1 * | 11/2016 | Ikemi | B22F 7/062 |

* cited by examiner

VALVE BODY OF A GAS EXCHANGE VALVE, GAS EXCHANGE VALVE AND INTERNAL COMBUSTION ENGINE

BACKGROUND OF THE INVENTION

1. Field of the Invention

The invention relates to a valve body of a gas exchange valve a gas exchange valve for an internal combustion engine, and an internal combustion engine.

2. Description of the Related Art

Internal combustion engines known from practice comprise gas exchange valves, namely inlet-side gas exchange valves, via which charge air can be fed to cylinders of the internal combustion engine, and exhaust-side exchange valves, via which exhaust gas can be discharged from the cylinders of the internal combustion engine.

Each gas exchange valve of an internal combustion engine comprises a valve body, wherein a valve seat interacts with the valve body. With a closed gas exchange valve, the valve body lies against the valve seat with a defined region whereas with an opened gas exchange valve this region of the valve body does not lie against the valve seat. A further region of the valve body faces a combustion chamber of the respective cylinder.

Valve bodies of gas exchange valves known from practice are produced in one piece and continuously from one and the same material. As a consequence of increasingly higher pressures and temperatures in the combustion chambers of cylinders, the requirements on the valve bodies of gas exchange valves increase with respect to corrosion to be avoided, deposits to be avoided, and wear to be avoided. With valve bodies known from practice, this can be guaranteed only inadequately.

SUMMARY OF THE INVENTION

One aspect of the present invention is based on creating a new type of valve body of a gas exchange valve, a gas exchange valve having such a valve body and an internal combustion engine having such a gas exchange valve.

According to one aspect of the invention, the valve body is formed in multiple parts, wherein the valve body comprises a first valve disc part interacting with the valve seat and a second valve disc part that is connected in a fixed manner to the first valve disc part and faces a combustion chamber of the cylinder. Between the first valve disc part and the second valve disc part a hollow space serving at least for the cooling of the second valve disc part is formed.

The valve body according to one aspect of the invention is formed in multiple parts and comprises a hollow space. By way of the hollow space at least the valve disc part that faces the combustion chamber of the cylinder can be cooled in a defined manner. Furthermore, the individual valve disc parts can be produced from materials, which based on the respective loads acting on the respective valve disc part, are exactly tailor made. Because of this, it is not only corrosion that can be reduced but deposits and other wear of the valve body can also be effectively counteracted.

Preferentially, the first valve disc part is formed from a metallic material having a first corrosion resistance and the second valve disc part is formed from a metallic material having a second corrosion resistance which is higher compared with the first corrosion resistance. Corrosion on the second valve disc part, which faces the combustion chamber of the cylinder and which as a consequence of the loads acting on the same is particularly susceptible to corrosion, can thus be effectively counteracted.

According to an advantageous further development, the hollow space is flowed through by a cooling medium. Alternatively, the hollow space is filled with a cooling medium. Both alternatives allow an effective cooling of the valve body at least in the region of the second valve disc part and likewise in the region of the first valve disc part. Here, an active cooling can be utilized by way of a cooling medium flowing through the hollow space or a passive cooling by way of a hollow space filled with cooling medium.

Preferentially, the first valve disc part and the second valve disc part are connected in a fixed manner by welding. A metallurgical connection of the two valve disc parts by welding is particularly preferred.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are explained in more detail by way of the drawing without being restricted to this.

There it shows.

DETAILED DESCRIPTION OF THE PRESENTLY PREFERRED EMBODIMENTS

One aspect of the invention relates to a valve body for a gas exchange valve of an internal combustion engine, to a gas exchange valve having such a valve body, and to an internal combustion engine having such a gas exchange valve.

Figure 1:
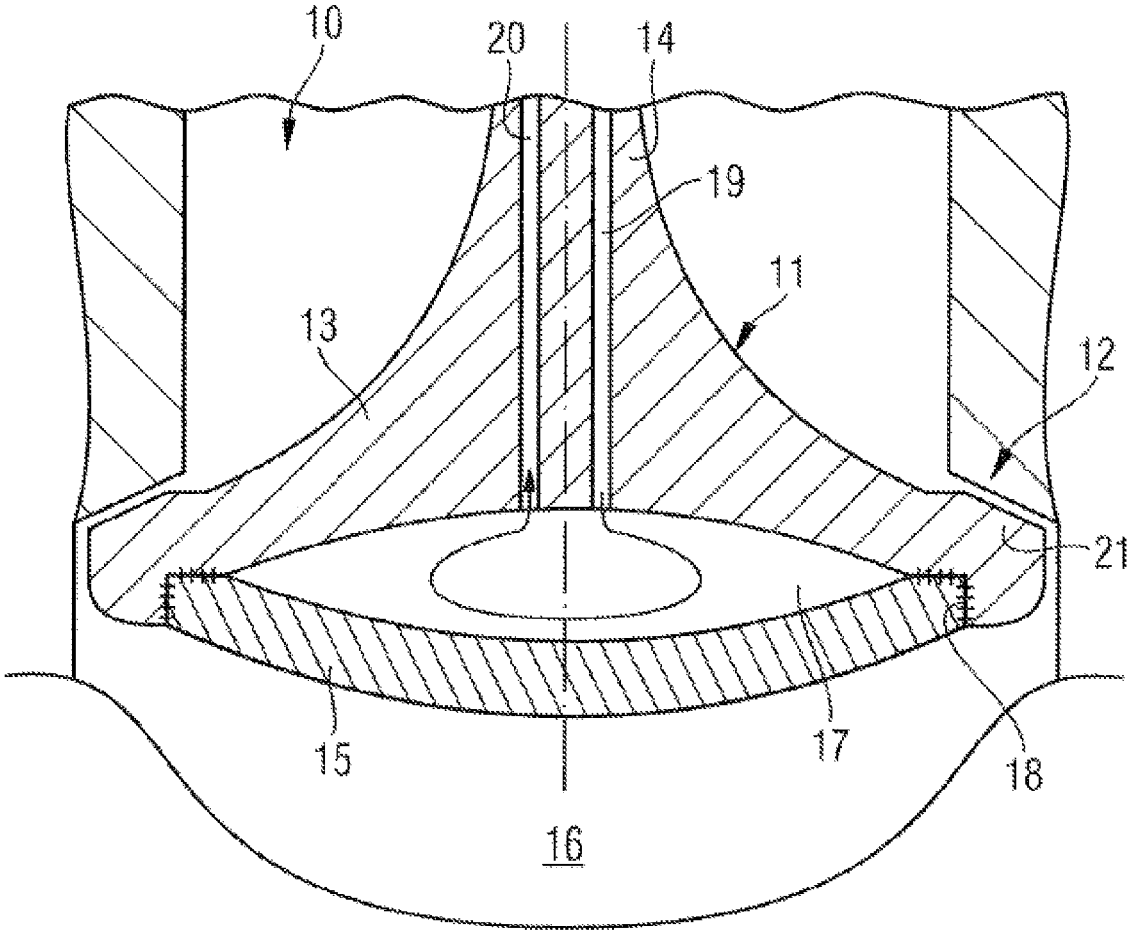
FIG. 1 is an extract from an internal combustion engine in the region of a gas exchange valve or of a valve body of the gas exchange valve.

FIG. 1 shows an extract from a gas exchange valve 10 of a cylinder of an internal combustion engine in the region of a valve body 11 and of a valve seat 12 configured to interact with the valve body 11.

When the gas exchange valve 10 is closed, the valve body 11 lies against the valve seat 12, whereas an open gas exchange valve 10 does not have the valve body 11 in contact with the valve seat 12 the valve body 11 is removed from or lifted off the valve seat 12.

The valve body 11 is formed in multiple parts. Accordingly, the valve body 11 comprises a first valve disc part 13, which is coupled to a valve stem 14 and which interacts with the valve seat 12. Accordingly, for a closed gas exchange valve 10, a lateral region 21 of the first valve disc part 13 lies against the valve seat 12.

In addition to this first valve disc part 13, which interacts with the valve seat 12 and which is coupled to the valve stem 14, the valve body 11 comprises a second valve disc part 15, which faces a combustion chamber 16 of the cylinder of the internal combustion engine. Between the first valve disc part 13 and the second valve disc part 15 a cavity 17 is formed that serves at least for cooling of the second valve disc part 15 and also for the cooling of the first valve disc part 13.

Both the first valve disc part 13 and the second valve disc part 15 are formed from metallic materials. Accordingly, the metallic material of the first valve disc part 13 has a first corrosion resistance and the material of the second valve disc part 15 a second corrosion resistance which is higher or greater than the first corrosion resistance of the material of the first valve disc part 13.

The first valve disc part 13 is preferentially produced from valve cone steel. The second valve disc part 15 is preferentially formed from a nickel-based alloy steel.

The two valve disc parts 13 and 15, which enclose the hollow space 17, are preferentially connected to one another by welding. FIG. 1 shows a weld seam 18 in the connecting region between the two valve disc parts 13, 15. The welding of the metallic valve disc parts 13, 15 is preferred to guarantee a durable connection between the two valve disc parts.

As already explained, the hollow space 17 serves for the cooling of the valve body 11, preferentially the cooling of both valve disc parts 13, 15, in particular of the second valve disc part 15, which faces the combustion chamber 16 of the cylinder.

In FIG. 1 the hollow space 17 is flowed through by a cooling medium, wherein the cooling medium in the hollow space 17 is fed via a feed 19 and discharged from the hollow space 17 via a discharge 20. Feed 19 and discharge 20 penetrate the first valve disc part 13 and the valve stem 14. In particular water, oil or even air serves as a cooling medium that flows through the hollow space 17 of the valve body 11.

Figure 2:
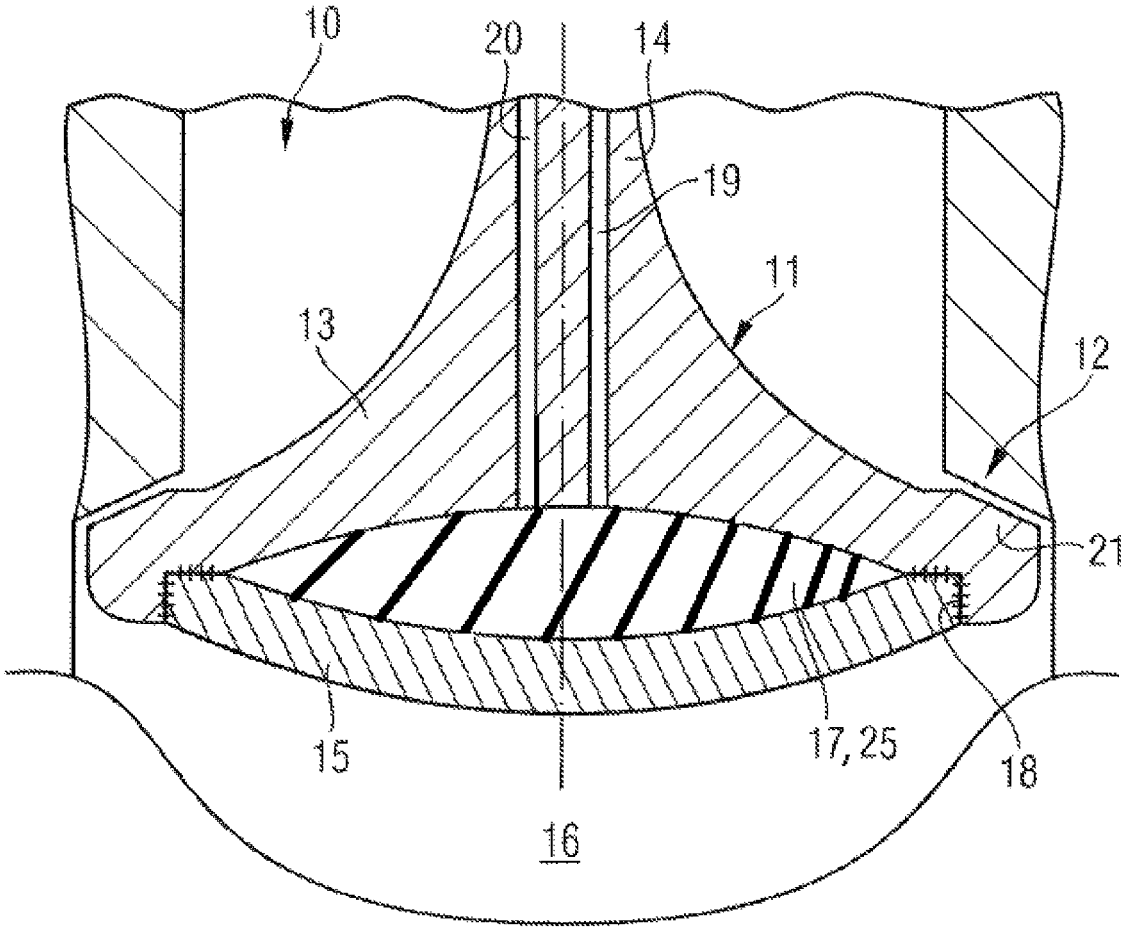
FIG. 2 is an extract from an internal combustion engine in the region of a gas exchange valve or of a valve body of the gas exchange valve.

Alternatively to an active, controllable cooling with a hollow space 17 flowed through by a cooling medium, passive cooling is also possible, namely in that the hollow space 17 is filled with a cooling medium 25, for example with a ceramic material, a metal foam, or a fluid as shown in FIG. 2. By way of the filling of the hollow space 17 with a metal foam or a ceramic material, a distortion of the valve body 10 can be compensated or a distortion counteracted by way of the different heat expansion coefficients of the individual materials so that the valve body 10 is not subjected to any distortion during operation throughout its entire temperature range.

According to one aspect of the invention, pressures and temperatures that ultimately are present in the combustion chamber 16 of a cylinder can be increased since the valve body 11 of the gas exchange valve 10 can withstand high loads. The valve body 11 according to the invention can be exposed to higher mechanical and thermal loads than prior valve bodies without a cavity.

The valve body 11 according to the invention can be employed both with inlet-side gas exchange valves for charge air and also with exhaust-side gas exchange valves for exhaust gas on cylinders of an internal combustion engine. Particularly preferred is the use with internal combustion engines operated with heavy fuel oil such as for example internal combustion engines of ships since the risk of a deposit formation of corrosion on the valve body 11 is particularly high.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A valve body for a gas exchange valve of a cylinder of an internal combustion engine, comprising:

a first unitary valve disc part of the valve body having a valve stem and configured to interact with a valve seat;

a second valve disc part of the valve body connected to the first valve disc part in a fixed manner and arranged to face a combustion chamber of the cylinder;

a feed for the cooling medium arranged in the first valve disc part; and a discharge for the cooling medium arranged in the first valve disc part, wherein the feed and discharge are each offset from a longitudinal axis of the valve stem, wherein a cross section of the feed and a cross section of the discharge are substantially equal, wherein the first valve disc part and the second valve disc part define a hollow space therebetween configured to at least cool the second valve disc part;

wherein the first valve disc part of the valve body is configured to close the gas exchange valve when it is in contact with the valve seat, and wherein the first valve disc part of the valve body is configured to open the gas exchange valve when removed from the valve seat.

2. The valve body according to claim 1, wherein the first valve disc part is formed from a first metallic material having a first corrosion resistance and the second valve disc part if formed from a second metallic material having a second corrosion resistance, and wherein the second corrosion resistance is higher than the first corrosion resistance.

3. The valve body according to claim 2, wherein the first metallic material is a valve cone steel and the second metallic material is a nickel-based alloy steel.

4. The valve body according to claim 1, wherein the hollow space is flowed through by a cooling medium.

5. The valve body according claim 1, wherein the hollow space is filled with a cooling medium.

6. The valve body according to claim 5, wherein the cooling medium is one of a metal foam and a ceramic material.

7. The valve body according to claim 1, wherein the first valve disc part is connected to the second valve disc part in a fixed manner by welding.

8. A gas exchange valve of an internal combustion engine, comprising:

a valve seat; and a valve body comprising:

a first unitary valve disc part of the valve body having a valve stem and configured to interact with a valve seat;

a second valve disc part of the valve body connected to the first valve disc part in a fixed manner and arranged to face a combustion chamber of the cylinder;

a feed for the cooling medium arranged in the first valve disc part; and a discharge for the cooling medium arranged in the first valve disc part, wherein the feed and discharge are each offset from a longitudinal axis of the valve stem, wherein a cross section of the feed and a cross section of the discharge are substantially equal;

wherein the first valve disc part and the second valve disc part define a hollow space therebetween configured to at least cool the second valve disc part;

wherein the first valve disc part of the valve body is configured to close the gas exchange valve when it is in contact with the valve seat, and wherein the first valve disc part of the valve body is configured to open the gas exchange valve when removed from the valve seat.

9. An internal combustion engine comprising:

at least one cylinder, wherein each cylinder comprises:

at least one inlet-side gas exchange valve for charge air; and at least one exhaust-side gas exchange valve for exhaust gas, wherein at least one of the respective inlet-side and exhaust-side gas exchange valve comprises:

a valve seat; and a valve body comprising:

a first unitary valve disc part of the valve body having a valve stem and configured to interact with a valve seat;

a second valve disc part of the valve body connected to the first valve disc part in a fixed manner and arranged to face a combustion chamber of the cylinder;

a feed for the cooling medium arranged in the first valve disc part; and a discharge for the cooling medium arranged in the first valve disc part, wherein the feed and discharge are each offset from a longitudinal axis of the valve stem, wherein a cross section of the feed and a cross section of the discharge are substantially equal;

wherein the first valve disc part and the second valve disc part define a hollow space therebetween configured to at least cool the second valve disc part; and wherein the first valve disc part of the valve body is configured to close the gas exchange valve when it is in contact with the valve seat, and wherein the first valve disc part of the valve body is configured to open the gas exchange valve when removed from the valve seat.

* * * * *